United States Patent [19]

Patel

[11] B 3,997,758

[45] Dec. 14, 1976

[54] MOISTURE CONTROL DEVICE FOR STEAM TURBINES

[75] Inventor: Neville K. Patel, Secane, Pa.

[73] Assignee: Westinghouse Electric Corporation, Pittsburgh, Pa.

[22] Filed: Mar. 14, 1974

[21] Appl. No.: 451,248

[44] Published under the second Trial Voluntary Protest Program on March 2, 1976 as document No. B 451,248.

[52] U.S. Cl. ..... 219/201; 219/372; 219/522; 244/134 D; 415/121 R; 416/95; 416/229 A

[51] Int. Cl.[2] ..... H05B 1/00; F01D 5/08; F04D 29/58

[58] Field of Search ..... 415/121 R, 1, 116, 177, 415/178; 244/134 R, 134 B, 134 D; 416/95–97, 224, 229; 219/200, 201, 369, 370, 372, 202, 522

[56] References Cited

UNITED STATES PATENTS

| | | | |
|---|---|---|---|
| 2,004,777 | 6/1935 | Bassler | 415/178 UX |
| 2,304,259 | 12/1942 | Karrer | 416/95 |
| 2,377,611 | 6/1945 | Caldwell | 415/178 UX |
| 2,540,472 | 2/1951 | Boyd | 219/201 |
| 2,547,934 | 4/1951 | Gill | 415/121 R |
| 2,690,890 | 10/1954 | Weeks et al. | 219/202 X |

FOREIGN PATENTS OR APPLICATIONS

| | | | |
|---|---|---|---|
| 681,186 | 10/1952 | United Kingdom | 415/121 R |
| 805,352 | 12/1958 | United Kingdom | 219/201 |

*Primary Examiner*—A. Bartis
*Attorney, Agent, or Firm*—G. H. Telfer

[57] ABSTRACT

An axial flow elastic fluid turbine apparatus includes a rotor having an annular array of circumferentially spaced blades. A casing encircles the rotor and an annular array of circumferentially spaced stationary nozzle blades is fastened the casing and arranged to direct the elastic fluid against the blades of the rotor. An outer covering is disposed over the radially outermost half of at least one blade of the stationary array and a thermal insulating member is disposed between the surface of the blade and the outer covering. Electric heating means are provided for raising the temperature of the outer covering to the Leidenfrost point, i.e., the point at which the temperature of the covering exceeds the vaporization temperature of the elastic fluid corresponding to the prevailing ambient pressure by more than 200° C., to evaporate water droplets which collect on the stationary blade and to prevent the accumulation of relatively smaller water droplets on the stationary blade. By preventing the accumulation of water droplets on the stationary blades, erosion of the rotor blades is avoided.

6 Claims, 2 Drawing Figures

MOISTURE CONTROL DEVICE FOR STEAM TURBINES

BACKGROUND OF THE INVENTION

1. Field of the Invention

This invention relates to steam turbines, and in particular, to an improved method of erosion control for rotating blades in the low pressure stage of a steam turbine.

2. Description of the Prior Art

In a low pressure stage of a steam turbine, a significant portion of the steam flowing through the turbine is in a liquid state. This fog of minute water droplets, suspended and carried by the steam flow, presents no hazard to the rotating blades when carried by the steam flow. However, these water droplets have been observed to accumulate on the outer reaches of stationary blading in the low pressure stages, and by so accumulating, form comparatively larger drops of water which are then torn from the stationary blades and impinge upon the leading edges of the rotating blades. Impingement of these relatively heavier water drops upon the leading edges of the rotating blades leads to what is known in the art as erosion.

Most of the erosion that has been observed occurs along the backside of the leading edge of the rotating blades. The erosion on the rotating blades becomes more severe as the blade tip is approached. At the tip, the erosion has been observed to be of such a magnitude as to cut a triangular notch into the rotating blade which threatens to sever the tip portion from the air foil portion of the blade.

In general, it is known that individual water droplets carried by the steam flow are unlikely to find a mechanism for agglomerating to a drop size able to cause erosion damage. It is obvious therefore that water droplets must collect in a more massive form on the stationary blade surfaces and then be pulled therefrom to produce drops of sufficient size to cause erosion of the rotating blades. The small droplets which are carried by the steam flow collect on the stationary blades to provide the source for the relatively larger drops.

There is generally considered two mechanisms of collection of the small water droplets on the stationary blades. The first mechanism is known to those skilled in the art as the direct impaction mechanism, while the second is known as the diffusion mechanism.

The direct impaction mechanism utilizes the momentum and inertia of relatively large water droplets to directly impact upon the surfaces of the stationary blades. The impaction mechanism is effective only for droplets greater than 1 micron in size. A micron is one-millionth of a meter. Once deposited, drops torn from the stationary blades by the steam flow cause severe damage as they impinge on the rotating blades near the rotating blade tips. However, the erosion damage throughout the radial length of the rotating blades is due to the deposition of fine water droplets carried in the steam flow on the stationary blades.

Since it has been shown that collection by the impaction mechanism does not result in the deposition of the fine water droplets carried by the flow on the stationary blades, the second well-known mechanism, that is, the diffusion mechanism, provides the source for the deposit of fine water droplets on the stationary blades. There are two types of diffusion processes well known in the art, the Brownian diffusion process and the eddy impaction process.

The Brownian diffusion process is a modification of the known mass transfer phenomena of eddy diffusion and molecular diffusion. When analyzed in terms of the problem under consideration, it has been found that the molecular diffusion phenomenon controls the deposition of the small water droplets close to the surface of the stationary blades, while the eddy diffusion phenomenon controls a distance away from the stationary blade surface.

The Brownian diffusion process is especially effective for water droplet sizes smaller than one-tenth of one micron.

When the droplet size becomes too large for Brownian diffusion yet too small to generate sufficient momentum to be controlled by the impaction mechanism, the second type of the diffusion mechanism, the eddy impaction process, becomes controlling. The process of eddy impaction occurs where the comparatively small water droplets, sized between one-tenth to one micron, have approached closely to the surface of the stationary blades in a manner described by the eddy diffusion phenomenon mentioned above. The momentum developed by these small water droplets is dissipated by viscous resistance as they travel to the stationary blade surface. The droplet velocity is essentially zero just before collection on the stationary blade surface. In this manner, the water droplets are deposited upon the stationary blade surface.

Collating, for droplet sizes greater than one micron, the direct implection mechanism best explains the collection process. However, the droplets so collected are dragged downstream on the stationary blade and drops torn therefrom primarily cause damage to the rotating blade tips. Damage to the radial length of the rotating blade occurs from water droplets collected on the stationary blading by either the Brownian diffusion process, for droplets less than one-tenth of a micron in size, or by the eddy impaction process, for droplets greater than one-tenth yet less than one micron in size.

Whatever mechanism utilized, the result is the agglomeration of water droplets from the wet steam on the stationary turbine blades. The droplets collected from the wet steam form larger drops of water which are swept from the stationary blades by the generally axial flow of steam.

Since the drops which have been torn from the stationary blades are relatively large and move at a velocity slower than the velocity of the rotating blade tip, the water drops impact on the backside of the rotating blades and result in erosion of the rotating blades, thus causing severe damage to the rotating blade, and a loss of energy and lowering of the efficiency of the low pressure stage.

It has been a practice in the prior art to coat the last several rows of rotating blades with a hard material, such as stellite. However, providing an erosion resistant material on the rotating blades is an expensive process and is not always adequate to overcome the erosive effects due to the impingement of water drops on the blades.

The prior art has also protected the rotating blades of low pressure stage by providing a suction slot adjacent the trailing edge of the stationary nozzle blades and connecting the slots directly to the low pressure condenser to draw the water deposited on the stationary blades directly to the condenser. It has also been found that an increase in the axial spacing between the rotating blades and the stationary blades will increase the velocity of the water drops and allow them to impact upon the leading edges of the rotating blades. However, this method of protecting the last row of rotating blades increases the turbine length, weight, and incidentially thereto, the cost.

SUMMARY OF THE INVENTION

This invention protects the rotating blades from erosion caused by impingement of water drops onto the leading edges of the rotating blades by disposing a heated outer covering on predetermined portions of each of the stationary blades. The outer covering is heated by a suitable arrangement to a predetermined temperature dependent upon the ambient pressure and temperature in the low pressure turbine blade row. The predetermined temperature of the stationary blades is greater than the vaporization temperature of the water at the ambient pressure and temperature.

The heated surface of the stationary blade row creates a temperature gradient in the fluid passing immediately above the heated surface. Radiometric forces exerted by the temperature gradient repel the small water droplets carried by the steam flow away from the heated surface. In consequence, the small water droplets collected by the Brownian diffusion and eddy impaction processes are repelled from the heated outer covering of the stationary blade and, since they have not been able to agglomerate on the stationary blades to a drop size sufficient to erode the moving blades, the water droplets carried by the steam flow pass through the rotating blade row without eroding the rotating blades.

In addition, heating of the portion of the stationary blades to a predetermined temperature in excess of the vaporization temperature of water at ambient pressure and temperature conditions will cause any water droplets which has been deposited on the stationary blade row through any collection mechanism to be vaporized from the stationary blade row, converting into useful steam, and passing through the rotating blades.

It is seen, that by heating outer covering of the stationary blade row to a predetermined temperature, accumulation of large water drops is avoided, thus avoiding erosion of the rotating blades, and in addition, useful work can be obtained by converting the deposited water into steam, thus improving the efficiency of the turbine.

It is an object of this invention to provide stationary blades having a heated outer covering thereon which, when heated to a predetermined temperature by suitable means, prevents formation and accumulation of large water drops thereon, to eliminate the erosion of the rotating blades in a low pressure steam turbine.

It is a further object of this invention to protect the rotating blades in a low pressure steam turbine from erosion by disposing on the stationary blades a heated outer portion, thus eliminating the expense and need for a hard material covering on the associated rotating blades. It is desirable, and therefore a further object of this invention, to increase the efficiency of the steam turbine by disposing a heated outer covering on the stationary blades to vaporize any water droplets collected by the stationary blades and to obtain therefrom steam able to do useful work on the rotating blades.

BRIEF DESCRIPTION OF THE DRAWINGS

The invention will be more fully understood from the following detailed description of an illustrative embodiment, taken in connection with the accompanying drawings, in which.

DESCRIPTION OF THE PREFERRED EMBODIMENT

Figure 1:
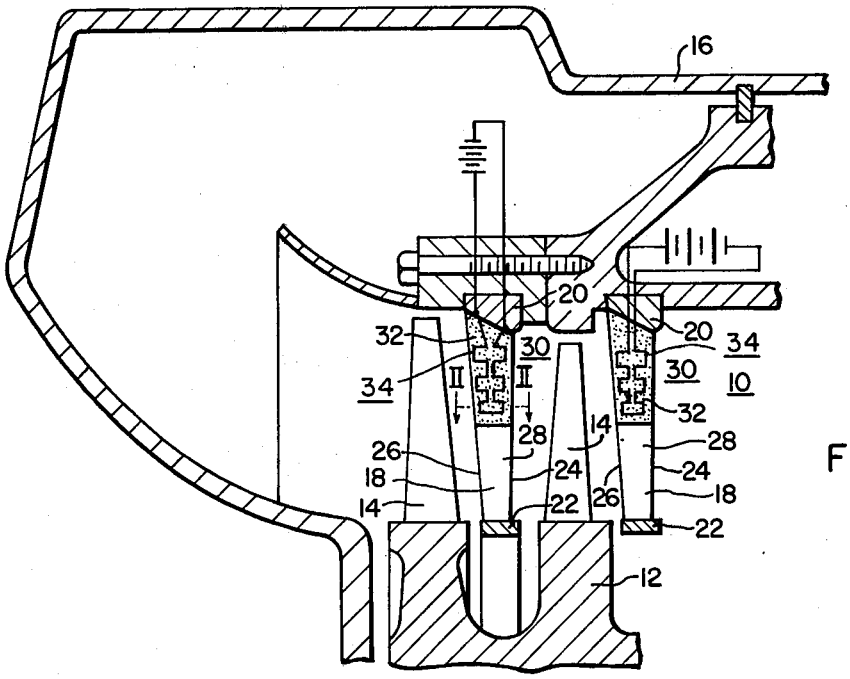
FIG. 1 is a partial sectional view of the low pressure stages of an axial flow steam turbine.

Throughout the following description similar reference characters refer to similar elements in all figures of the drawings.

FIG. 1 shows a low pressure stage of an axial flow steam turbine 10. The turbine 10 has a rotor 12, a plurality of annular arrays of circumferentially spaced rotating blades 14 fastened to the rotor 12, a casing 16 encircling the rotating blades 14 and the rotor 12, and a plurality of annular arrays of circumferentially spaced stationary nozzle blades 18, at least one of the plurality of annular arrays of nozzle blades 18 interposed between two annular arrays of rotatable blades 14. The stationary blades 18 are fastened to the casing 16 by an internal cylinder 20.

As shown in FIG. 1, the stationary nozzle blades 18 of the annular arrays of nozzle blades are fastened together adjacent the rotor 12 by a shroud ring 22 subtending each annular array of stationary nozzle blades 18. The nozzle blades 18 have a rounded leading edge 24 adjacent the upstream or right edge as shown in the drawings, a relatively sharp trailing edge 26 at the downstream or left edge as shown in the drawings, and an airfoil cross-section shape 28. The airfoil portion 28 is curved to change the direction of steam flow as it passes through the stationary nozzle blades 18, thus, each nozzle blade 18 has a concave-convex surface or portion thereon.

Disposed on a predetermined portion 30 on each of the stationary nozzle blades 18 is a heated outer covering 32 fabricated of thin aluminum, stainless steel, brass or copper. The outer covering 32 is heated by suitable heating means 34, illustrated in FIG. 1 by the schematic diagram of an electrical heating arrangement. However, it is to be understood, that any suitable means for heating the outer covering 32 of the stationary blades 18 is within the contemplation of this invention. It is also to be understood that although the drawing illustrates the last two stationary blade rows as having the heated portion thereon, the teachings of this invention can be utilized on any stationary blade in an axial flow steam turbine apparatus.

It is to be understood that herein disclosed is the concept of heating the outer covering 32 disposed on the predetermined portion of the blade 18 by the electrical heating arrangement 34 to a predetermined temperature, the magnitude of which is described more fully herein.

Figure 2:
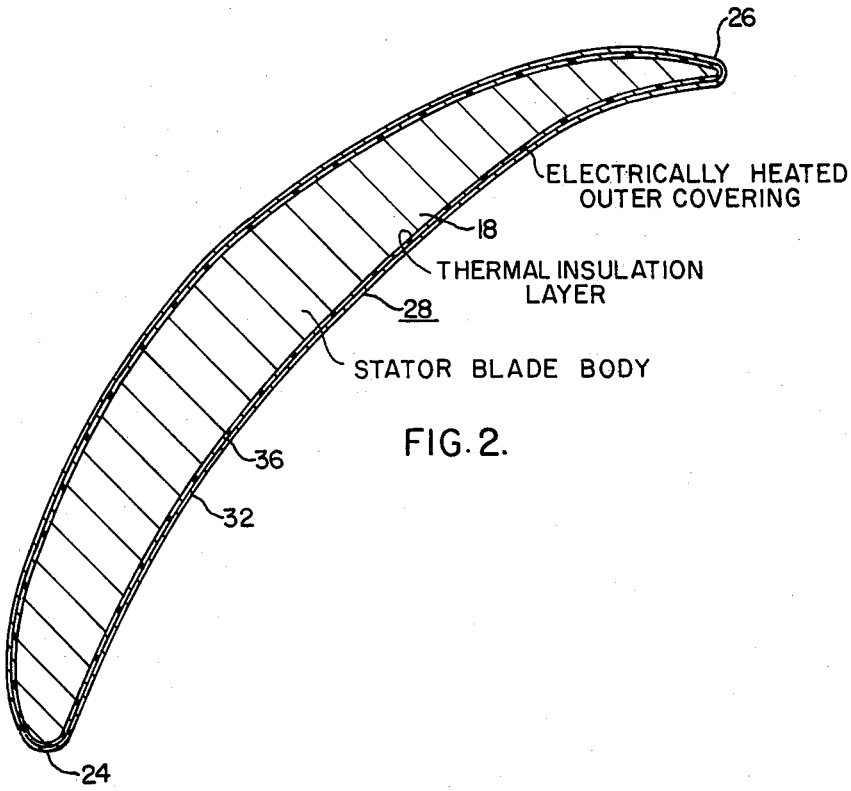
FIG. 2 is a sectional view of a stationary nozzle blade taken along section lines II—II of FIG. 1 and constructed in accordance with this invention.

Referring now to FIG. 2, a sectional view of one stationary blade 18 taken along section line II—II of FIG. 1 is shown. The stationary blade 18 is fabricated of a high alloy steel, and is surrounded by a thermal insulating material 36. Disposed around the thermal insulating material is the outer covering 32.

Heating of the outer covering 32 to a predetermined temperature, the magnitude of the predetermined temperature depending upon the ambient pressure and temperature in the section of the low pressure turbine 10 under consideration, has the effect of preventing formation and accumulation of water droplets on the stationary blade 18.

The predetermined temperature to which the outer covering 32 is to be heated is dependent upon the Leidenfrost point. The Leidenfrost point is, as is well known to those in the art, that point wherein the temperature of the blade covering exceeds the vaporization temperature of the fluid corresponding to the prevailing ambient pressure by more than 200°C. Thus, if the direct impaction mechanism is responsible for the deposition of water droplets of greater than 1 micron on the blade 28, the droplets so deposited would be evaporated before they could be torn from the stationary blade. If the diffusion mechansim is responsible for moisture deposition on the stationary blades, the predetermined temperature above the Leidenfrost point will prevent the deposition of the smaller than 1 micron droplets on the surface of the blade 28.

Heating of the outer covering 32 of the stationary blades may also preclude deposition of larger droplets having a relatively slow velocity. Such slow velocity, larger (50–500 microns in size) droplets, as they approach the heated surface, being to evaporate. The evaporation of a portion of these larger, slow moving droplets forms a vapor film interface between the unevaporated remainder of the droplet and the blade. Thus, the unevaporated remainder of the droplet floats on its own vapor interface, and is swept away by the axial steam flow before it is actually deposited on the blade surface. Similarly, very high velocity, larger droplets often impact against, and rebound from, the surface of the stationary blade. After rebound, however, these now slow-moving droplets undergo the same evaporation phenomena as is described above for the originally slow moving droplets, that is, due to the heat of the blade covering they float on their own vapor film interface and are swept away by the axial flow of steam before they are actually deposited upon the stationary blade surface.

It is seen that if water droplets were permitted to agglomerate on the stationary blades 18 and thus form larger drops which can be torn therefrom by the axial flow of steam through the turbine 10, the impingement of the large water drops upon the backside of the trailing edge of the rotating blade 14 will cause erosion of those blades. Heating the outer covering 32 to a temperature, depending upon the Leidenfrost point, which exceeds the vaporization temperature of water at the appropriate pressure and temperature in the area of the turbine 10 under consideration, will vaporize the water so deposited and convert the water to useful steam so that additional work may be obtained by passing the steam over the remaining rows of rotating blades 14.

In addition to vaporizing any water which has been deposited on the stationary blade 18, heating of the outer covering 32 by the suitable heating means 34 causes an increase in the temperature in the fluid medium surrounding the stationary blade 18. Increase in temperature in the fluid medium around the stationary blade 18 creates a temperature gradient within the fluid. The phenomenon known to those skilled in the art as theremophoresis arises from radiometric forces exerted by a fluid on a particle immersed therein when a temperature gradient exists within the fluid. In consequence, the particles are repelled by hot surfaces and attracted by cold ones. The magnitude of the radiometric forces produced by the thermophoresis effect is minute. However, especially in this case, the forces necessary to repel the fine water droplets, which collect on the stationary blade by the Brownian diffusion process of the eddy impaction process, away from the stationary blade surface are also necessarily small. Thus, maintaining high temperature in the surrounding heated material discourages the Brownian diffusion process and the eddy impaction process which predominates as the collection processes for the small water droplet sizes.

The operation of the thermophoresis phenomenon results from the heating of the fluid, in this case water vapor, adjacent the heated surface. By applying heat energy, the kinetic energy of the water molecules in the water vapor adjacent the heated surface is increased. Thus, activity of the water molecules is greater on the side of each individual water droplet carried by the steam flow that is closest to the heated surface, as opposed to the side of the droplet that is away from the heated surface. The increased movement of the water molecules, the side of the water droplets closest to the heated surface, results in a greater number of collisions between the water molecules and the individual droplets of water carried in the steam flow. The collisions occur mostly on the side of the individual droplet closest to the heated surface since the agitation of water molecules is greatest there. The net effect of the impingement of agitated water molecules on one side of the water droplet and not the other results in a net force unbalance which impels the water droplet away from the heated surface.

Since the temperature of the outer covering is above the vaporization temperature of water at the ambient pressure and temperature, any water which is deposited by any of the deposition mechanisms upon the stationary blades is vaporized. This vaporization of water deposited on the stationary blade produces useful steam which is utilized in the last rotating row of blades, thus improving the overall efficiency of the turbine. The efficiency of the turbine is also increased by the elimination or significant reduction in braking and drag losses.

Braking losses are caused when larger droplets, having diameters on the order of 50–500 microns, are torn from the trailing edges of the stationary blades by the stream flow. Since these larger droplets cannot be accelerated significantly by the steam in the small axial clearance between the stationary and rotating blades, they do not have sufficient velocity to traverse the axial distance quickly enough to impinge upon the front side of the rotating blades. The constant bombardment of these larger droplets on the backside of the leading edges of the rotating blades gives rise to a negative torque being impressed upon the rotating blade, which is known as the braking loss.

A further concomitant to the tearing of larger droplets from the trailing edges of the stationary blades is the so-called "drag" loss. This is caused by the expenditure of kinetic energy from the steam flow necessary to tear the droplets from the stationary blades and to accelerate them toward the rotating blades.

Both the braking and drag losses are significantly reduced or eliminated by utilization of the stationary blading taught by this invention. Since agglomeration of larger droplets on the stationary blades is discouraged by the heated stationary blade covering and since larger-sized droplets are the predominant cause of these losses, it follows that if the blade coverings are heated, the agglomeration of larger-sized droplets are eliminated or significantly reduced, and the drag and braking losses are thereby also eliminated or significantly reduced. Thus, the efficiency of the turbine is enhanced.

Usually the portion of the stationary blades to be covered by the heated covering is the outermost 40% of the stationary blade. That is, it is essentially the outer 40% of the stationary blade 18, determined relative to the rotating shaft 12, that is heated to the predetermined temperature. However, any portion of any stationary blade 18 may be covered with an outer covering 32 which is heated to a predetermined temperature by the heating means 34 to achieve the results above described.

The insulating member 36, suitably any commercial insulation for operation in temperature range of 100°–500°F, which is disposed between the high alloy blade member 18 and the outer covering 32 surrounding the blade 18 prevents a flow of heat from the heated outer covering 32 into the high alloy steel blade 18. Since the insulation 36 is so disposed, heat conduction away from the outer covering 32 of the blade 18 will be discouraged, thus ensuring that the outer blade covering 32 is maintained at the predetermined temperature level.

The thermophoresis effect implies no heat transfer from the hot outer covering 32 into the water droplets, because the action of the thermophoresis effect is to repel the fine water particles and prevent them from alighting upon the stationary blade 18. Thus, a negligible energy loss occurs between the heated surface 32 and the fine water droplets when utilizing the thermophoresis effect.

It is seen that disposing an outer covering surrounding a predetermined portion of each stationary blade in an array of stationary blades, and heating that covering to a predetermined temperature by suitable means prevents the formation of liquid drops which cause erosion of the associated rotating blade members. By repelling the fine water droplets through the phenomenon of thermophoresis, and by vaporizing those water droplets that normally would have become deposited upon the stationary blade, water drops of sufficient size to damage the rotating blades cannot be formed. Thus, erosion of the rotating blades will be eliminated. In addition, the increased savings from eliminating stellite applications on the rotating blades will reduce the cost of turbine construction. As a further benefit, the efficiency of the machine will be improved, since useful work will be accomplished as the vaporized water droplets pass through the rotating blade row, and since energy savings from reduction in drag and brakage losses also occur.

I claim as my invention:

1. An axial flow, elastic fluid turbine apparatus comprising:

a rotor;

an annular array of circumferentially spaced rotatable blades fastened to said rotor for rotation therewith;

a casing encircling said array of rotatable blades and said rotor;

an annular array of circumferentially spaced stationary nozzle blades fastened to said casing, said annular array of stationary nozzle blades adapted to direct elastic fluid against said array of rotatable blades;

an outer covering disposed over a predetermined portion of at least one of said stationary nozzle blades;

a thermal insulating member disposed between said one of said stationary nozzle blades and said outer covering; and electrical means for raising the temperature of said outer covering to the Leidenfrost point to prevent the deposition of moisture droplets entrained within an elastic fluid flow on said outer covering to inhibit the agglomeration thereof into larger moisture drops to prevent erosion of said rotatable blades within said annular array of rotatable blades.

2. The turbine of claim 2 having a plurality of annular arrays of stationary nozzle blades therein, one of said plurality of arrays being a last array of stationary nozzle blades, and, wherein said outer covering is disposed over said predetermined portion of said one of said stationary nozzle blades in said last array.

3. The turbine of claim 2, wherein said turbine has an axis extending therethrough, and wherein said predetermined portion comprises substantially the radially outermost half of said stationary nozzle blade relative to said axis.

4. The turbine of claim 2, wherein another of said plurality of annular arrays of stationary nozzle blades being a next-to-last array of stationary nozzle blades, and further comprising:

an outer covering disposed over a predetermined portion of at least one of said stationary nozzle blades in said next-to-last annular array of stationary nozzle blades;

a thermal insulating member disposed between said one of said stationary nozzle blades in said next-to-last array of stationary nozzle blades and said outer covering; and, electrical means for raising the temperature of said outer covering on said one of said stationary nozzle blades in said next-to-last array of stationary nozzle blades to the Leidenfrost point to prevent the deposition of moisture droplets entrained within an elastic fluid flow on said outer covering to inhibit the agglomeration thereof into larger moisture drops to prevent erosion of said rotatable blades within said annular array of rotatable blades.

5. The turbine of claim 4, wherein said turbine has an axis extending therethrough, and wherein, said predetermined portion of said one of said stationary nozzle blades in said last array of stationary nozzle blades comprises substantially the radially outermost half of said stationary nozzle blade relative to said axis.

6. The turbine of claim 5, wherein said predetermined portion of said one of said stationary nozzle blades in said next-to-last array of stationary nozzle blades comprises substantially the radially outermost half of said one of said stationary nozzle blade relative to said axis.

* * * * *